US006686690B1

(12) United States Patent
Alwan

(10) Patent No.: US 6,686,690 B1
(45) **Date of Patent: *Feb. 3, 2004**

(54) TEMPORARY ATTACHMENT PROCESS AND SYSTEM FOR THE MANUFACTURE OF FLAT PANEL DISPLAYS

(75) Inventor: James J. Alwan, Boise, ID (US)

(73) Assignee: Micron Technology, INC, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/136,909

(22) Filed: May 1, 2002

Related U.S. Application Data

(63) Continuation of application No. 09/170,705, filed on Oct. 13, 1998, now Pat. No. 6,392,334.

(51) Int. Cl.[7] ..... H01J 1/64; H01J 63/04

(52) U.S. Cl. ..... 313/495; 313/422; 313/493; 313/497

(58) Field of Search ..... 313/422, 495, 313/493, 497, 496; 445/24, 25

(56) References Cited

U.S. PATENT DOCUMENTS

| | | | | |
|---|---|---|---|---|
| 5,229,331 A | | 7/1993 | Doan et al. | |
| 5,329,207 A | | 7/1994 | Cathey et al. | |
| 5,358,908 A | | 10/1994 | Reinberg et al. | |
| 5,372,973 A | | 12/1994 | Doan et al. | |
| 5,391,259 A | | 2/1995 | Cathey et al. | |
| 5,679,960 A | | 10/1997 | Akama | 257/10 |
| 5,764,001 A | * | 6/1998 | Khan et al. | 313/582 |
| 5,807,154 A | | 9/1998 | Watkins | |
| 6,392,334 B1 | * | 5/2002 | Alwan | 445/25 |

OTHER PUBLICATIONS

Shen and Konh, "*Force on Dielectric Material*", Applied Electromagnetism, 2d Ed., pp. 327–331.

Lee Branst, Floyd Pothoven, "*The Challenge of Flat Panel Display Sealing*", Jan. 1996, Semiconductor International, pp. 109–112.

* cited by examiner

*Primary Examiner*—Nimeshkumar D. Patel
*Assistant Examiner*—Mariceli Santiago
(74) *Attorney, Agent, or Firm*—Knobbe Martens Olson & Bear, LLP

(57) ABSTRACT

A process for fabricating a flat panel display having a faceplate and a baseplate comprises creating an electric field between the faceplate and the baseplate to temporarily attract the faceplate to the baseplate and attaching the baseplate and faceplate to each other while the electric field is present. Capacitor(s) are formed on the faceplate and/or baseplate of a flat panel display such that a portion of the capacitor(s) is formed on the faceplate and is aligned with the pixel matrix and/or a portion of the capacitor(s) is formed on the baseplate and is aligned with the cathode member. The first and second portions of the capacitor(s) are energized to opposite polarity voltages, and an electric field is generated which attracts and aligns the two portions of the capacitor(s) to each other. When the two portions of the capacitor(s) are aligned and attracted to each other, the pixel matrix and cathode assembly are inherently aligned with each other. Once the faceplate and the baseplate are attached to each other, the capacitor(s) are de-energized and the electric field is dissipated.

16 Claims, 9 Drawing Sheets

TEMPORARY ATTACHMENT PROCESS AND SYSTEM FOR THE MANUFACTURE OF FLAT PANEL DISPLAYS

This is a continuation of U.S. patent application Ser. No. 09/170,705 filed on Oct. 13, 1998, Now U.S. Pat. No. 6,392,334 the entire contents of which is incorporated herein by reference.

GOVERNMENT RIGHTS

This invention was made with U.S. Government support under contract No. DABT63-97C-0001 awarded by the Advanced Research Projects Agency (ARPA). The U.S. Government has certain rights in this invention.

BACKGROUND OF THE INVENTION

1. Field of the Invention

The invention relates to flat panel displays. In particular, the invention relates to a process of manufacturing field emission displays.

2. Description of the Related Art

The Field Emission Displays ("FED") is a fat panel display type that may be able to compete with the liquid crystal display (LCD). FEDs have the advantages of being potentially lower in cost, low power consumers, having a better viewing angle, having higher brightness, having less smearing of fast moving video images, and being tolerant to greater temperature ranges than other display types.

Typically, a FED comprises a faceplate and a baseplate separated by spacers. A luminescent phosphor coating is applied to the inside surface of the faceplate to form phosphorescent pixel sites arranged in a matrix. Electrons from a cathode member bombard the coating in a pre-determined pattern to produce an image. The cathode member is formed by depositing micron-high sharp-tip cones thereon to form individual electron-emission sites or cathode tips which emit electrons to activate the corresponding pixels. In operation, a positive voltage (relative to the emitters) is applied to an extraction grid surrounding the emitters to produce an intense electrical field. This field is necessary for cold cathode emission. In some embodiments, the cathode member is attached to or integrally formed with the baseplate, and in other embodiments, the cathode member is attached to the faceplate and surrounded by a separate baseplate. In either case, the cathode member must be aligned with the faceplate so that the cathode tips are in opposed relation to the specific pixels which they are intended to activate.

A vacuum gap, ranging from a few tens of microns to many millimeters, separates the faceplate from the baseplate. Making the gap as small as possible lowers the extraction voltage required to accelerate the electrons from the cathode member on the baseplate to the phosphorescent coating on the faceplate which in turn reduces the cost of the driver electronics. The vacuum gap can be maintained by either a sealing member, a spacer or both. The sealing member and/or spacers maintain the required vacuum between the faceplate and baseplate (for example 10–6 Torr) and prevent the outside atmospheric pressure from collapsing them onto each other. Any degradation of the vacuum can result in a number of problems including the overall reduction in the working lifetime of the display. One of the most severe problems is nonuniform brightness of the display caused by contaminant gasses degrading the emitter tips, resulting in intermittent emissions. Thus, maintaining proper seal between the faceplate and baseplate is crucial to the proper operation of the display.

During the manufacture of the FED, the alignment of the cathode tips on the baseplate with their corresponding pixels on the faceplate must be maintained while the seal between the faceplate and the baseplate is formed. Maintaining the proper pixel alignment while forming the seal during assembly is a problematic task. In the prior art, once the faceplate and baseplate are aligned, temporary and permanent adhesives have been used to hold the faceplate and baseplate together in their aligned state while the seal between the two is being formed. Further, sealing typically occurs under a combination of high temperatures and high vacuum. However, internal cleanliness is critical. Thus, temporary attachment must therefor be accomplished with materials that do not outgas appreciably (unlike epoxy). Additionally, the application of the adhesive to the faceplate and baseplate necessarily requires an additional assembly step which increases assembly time and cost. Also, concerns over the long term stability of the permanent adhesives have made them less desirable to use. Further, temporary adhesives require yet another assembly step to remove the adhesive once the seal has been formed. Thus, there exists a need for a different manner of maintaining the alignment of the faceplate and the baseplate of a field emission display to enable the sealing process to be completed.

SUMMARY OF THE INVENTION

A process for fabricating a flat panel display having a faceplate and a baseplate comprises creating an electric field between the faceplate and the baseplate to temporarily attract the faceplate to the baseplate and attaching the baseplate and faceplate to each other while the electric field is present.

In accordance with one embodiment, a first portion of a capacitor is formed on faceplate and a second portion of a capacitor is formed on the baseplate. The first and second portions of the capacitor are energized using opposite polarity voltages to create an electric field which produces an attractive force between the faceplate and baseplate. The baseplate and faceplate are then attached to each other while the attractive force is present. Preferably, when the baseplate and faceplate are attached to each other a seal is formed between the faceplate and the baseplate. Once attached, the first and second portions of the capacitor are de-energized to remove the attractive force between the faceplate and baseplate.

In accordance with one aspect of the present invention, the faceplate has a pixel matrix and the baseplate has a cathode member. When the first portion of the capacitor is formed on the faceplate, the first portion of the capacitor is aligned with the pixel matrix. When the second portion of the capacitor is formed on the baseplate, the second portion of the capacitor is aligned with the cathode member. Therefore, when the first and second portions of the capacitor are energized and the attractive force is created between the first and second portions of the capacitor, the pixel matrix and the cathode member are automatically aligned with each other.

In one embodiment, at least one capacitor is formed between the faceplate and baseplate. In another embodiment, at least two capacitors are formed between the faceplate and baseplate with the at least two capacitors located on opposite corners of the faceplate and baseplate. In a preferred embodiment, four capacitors are formed between the faceplate baseplate, one on each corner thereof.

In another embodiment, the process for fabricating a flat panel display comprises forming a plurality of interdigitated conductors on the baseplate. A first plurality of the conductors are energized to a first polarity voltage and a second plurality of the conductors are energized to a second polarity voltage, thereby creating an electric field above the baseplate. The faceplate is then placed in proximity to the baseplate while the electric field is present. Electrostatic force from the electric filed pulls the faceplate and adheres it to the baseplate. The baseplate and faceplate are attached to each other while the electric field is present. After the baseplate and faceplate are attached to each other, the first and second plurality of conductors are de-energized thereby dissipating the electric field. In an alternate embodiment, the array of conductors are formed on the faceplate and the baseplate is attracted to the faceplate when the conductors are energized to opposite polarity voltages.

In accordance with another aspect of the present invention, a flat panel display comprising a faceplate and a baseplate, further comprises a capacitor having first and second portions thereof. The first portion of the capacitor is formed on the faceplate and the second portion of the capacitor is formed on the baseplate. The faceplate comprises a pixel matrix and the first portion of the capacitor is preferably aligned with the pixel matrix. The baseplate further comprises a cathode member and the second portion of the capacitor is preferably aligned with the cathode member.

In one embodiment, the first portion of the capacitor comprises a metal layer and a dielectric material layer and the second portion of the capacitor comprises a metal layer. In another embodiment, the second portion of the capacitor further comprises an oxide layer. In still another embodiment, the first portion of the capacitor comprises a metal layer and the second portion of the capacitor comprises a metal layer and a dielectric material layer.

DETAILED DESCRIPTION OF THE PREFERRED EMBODIMENT

Figure 1:
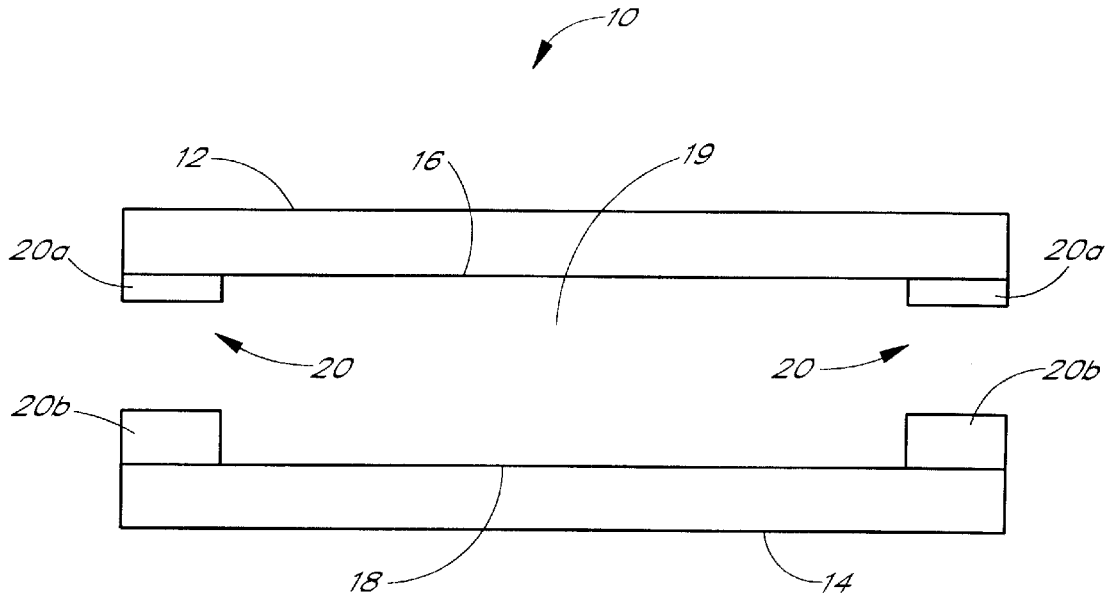
FIG. 1 is a side view of a faceplate and a baseplate of a flat panel display in accordance with an embodiment of the present invention.

Referring to FIG. 1, a flat panel display 10 is shown comprising a faceplate 12 and a baseplate 14. In the preferred embodiment, the flat panel display 10 is a field emission display (FED). In the embodiment shown, the faceplate 12 comprises a luminescent phosphor coating on the inside surface of the faceplate 12 forming a plurality of phosphorescent pixel sites in an arranged pattern, referred to as a pixel matrix 16, as described in U.S. Pat. No. 5,695,661, incorporated herein by reference.

In the embodiment shown, a cathode member 18 is integrally formed with the baseplate 14, as in U.S. Pat. No. 5, 391,259, incorporated herein by reference. According to alternative embodiments (not shown), the cathode member 18 may be separate from and surrounded by the baseplate 14. The cathode member 18 comprises a plurality of individual electron-emission sites or cathode tips which emit electrons to activate corresponding pixels on the pixel matrix 16.

The faceplate 12 and baseplate 14 are separated by a vacuum gap 19. In some embodiments, a spacer (not shown) can be used to maintain the gap 19 between the faceplate 12 and baseplate 14. The faceplate 12 and baseplate 14 are made of glass according to some embodiments. Acceptable glasses include: Corning 7059, 1737 and soda-lime glass.

Figure 2:
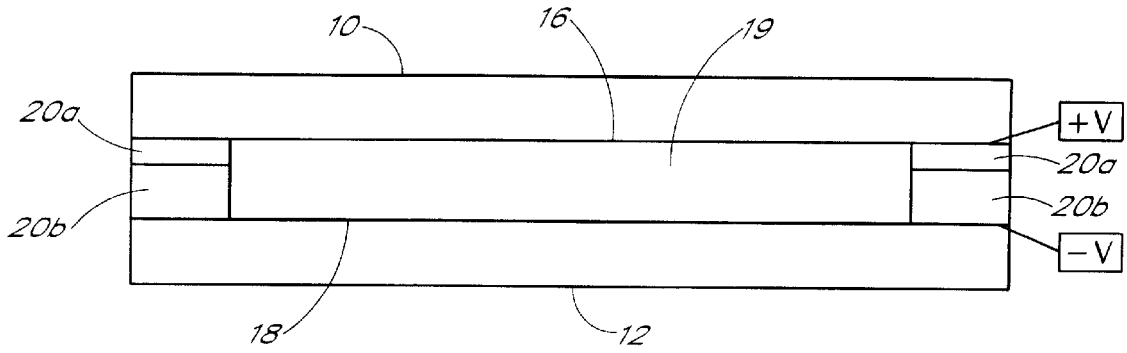
FIG. 2 is a side view of a faceplate and a baseplate of a flat panel display in an aligned and attracted state in accordance with an embodiment of the present invention.

According to one embodiment of the present invention, a capacitor 20 is formed between the faceplate 12 and baseplate 14 such that a first portion 20*a* of the capacitor 20 is formed on the faceplate 12 and a second portion 20*b* of the capacitor 20 is formed on the baseplate 14. Referring also to FIG. 2, when the first portion 20*a* of the capacitor 20 on the faceplate 12 and the second portion 20*b* of the capacitor on the baseplate 14 are energized by opposite polarity voltages +V and −V, respectively, an electric field is created. The electric field causes the first and second portions 20*a*, 20*b* of the capacitor 20 to be attracted to each other and the faceplate 12 and baseplate 14 are held together by this force.

Figure 3:
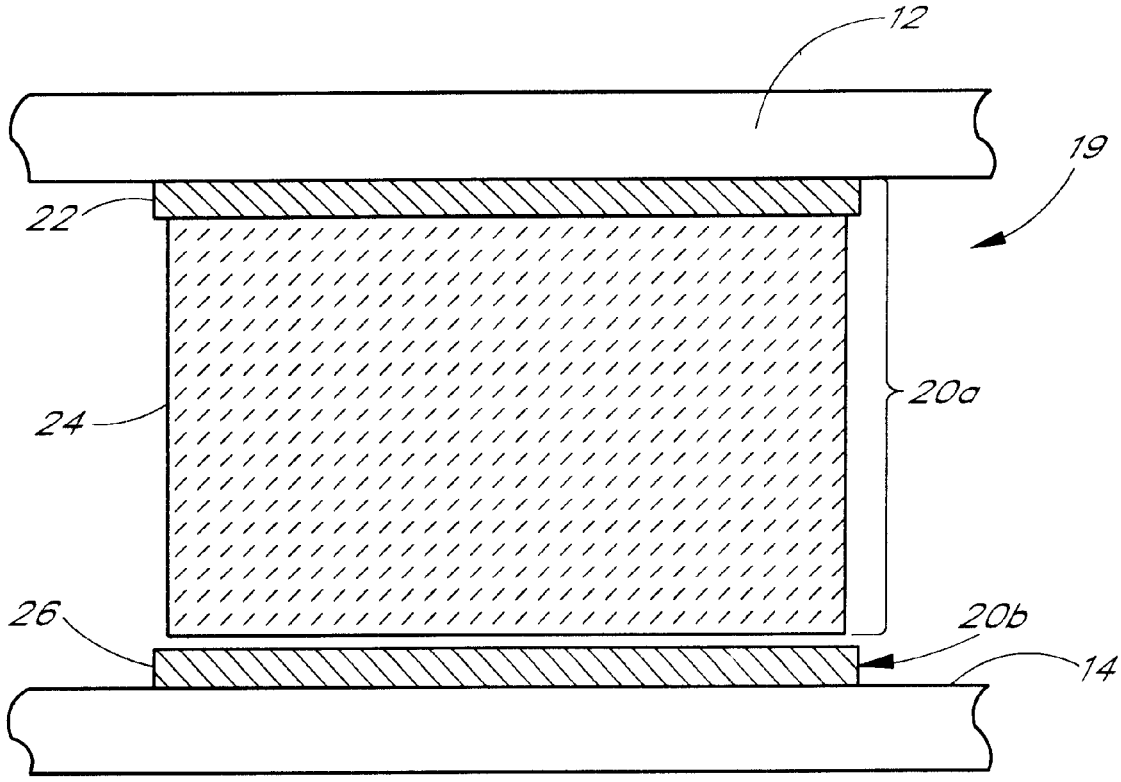
FIG. 3 is a cross sectional view of a capacitor formed on a faceplate and a baseplate of a flat panel display in accordance with an embodiment of the present invention.

Referring to FIG. 3, in one embodiment the first portion 20*a* of the capacitor 20 which is formed on the faceplate 12 comprises a first metal plate 22 and a dielectric material 24. The second portion 20*b* of the capacitor 20 which is formed on the baseplate 14 comprises a second metal plate 26. In this embodiment, the distance between the first metal plate 22 on the faceplate 12 and the second metal plate 26 on the baseplate 14 is defined by the thickness of the dielectric material 24.

Figure 4:
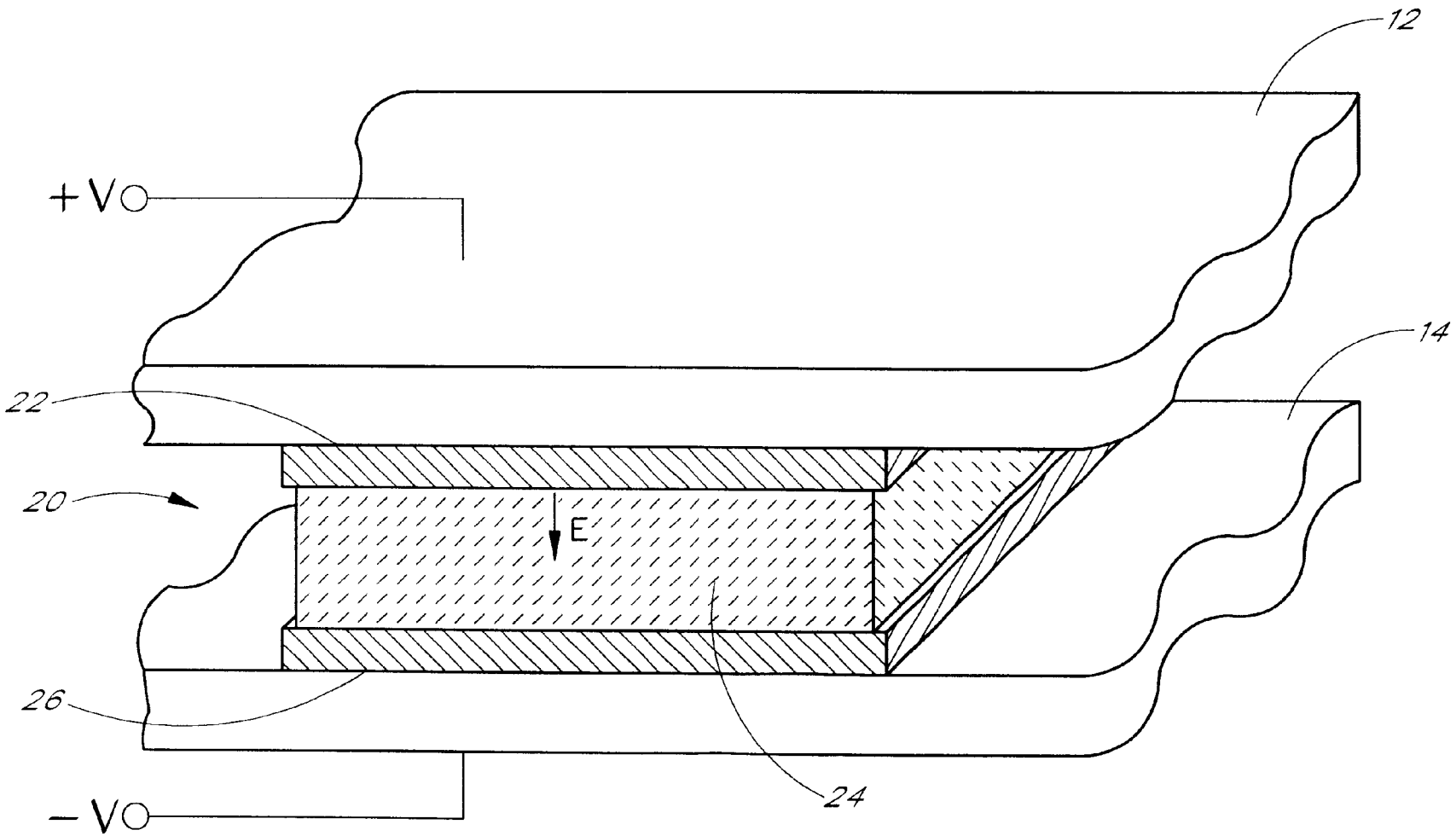
FIG. 4 is a schematic view of the forces acting on the capacitor in accordance with an embodiment of the present invention.

More specifically, as shown in FIG. 4, the force experienced by the faceplate 12, when the first and second metal plates 22, 26 are energized by opposite polarity voltages +V and −V, is defined by the equation F=QE, where Q is the total charge on the first metal plate 22 (defined by the equation Q=CV) and E is the electric field created between the first and second metal plates 22, 26 (defined by the equation E=V/d), thus $$F = CV * \frac{V}{d} = \frac{CV^2}{d} \text{ and } C = \frac{EA}{d}, \text{ so } F = \frac{\epsilon A}{d} * \frac{V^2}{d} = \frac{\epsilon A V^2}{d^2},$$

where $\epsilon$ is the dielectric constant for the material, A is the area of the plate of the capacitor, V is the applied voltage and d is the distance between the first and second metal plates 22, 26.

In one example, the dielectric material 24 is silicon dioxide ($SiO_x$) having an $\epsilon_r$=3.5 ($\epsilon_0$=8.85×10$^{-12}$ F/M), the plate of the capacitor is 500 microns×500 microns thus A=250(10$^{-9}$)m$^2$or 3.875 (10$^4$) in$^2$, the distance between the plates d=10$^{-6}$ m and the voltage applied between the plates V=100 volts. The force on the plate of one capacitor can be calculated using the above equation to be:

$$F = \frac{(3.5) * \left(8.85 \times 10^{-12} \frac{F}{m}\right) * (250 \times 10^{-9} m^2) * (100V)^2}{(10^{-6} m)^2}$$

$$F = 0.77 F \frac{V^2}{m} \cdot \frac{1m}{100 \text{ cm}} = 7743 \text{ dynes} = 0.0174 \text{ lbs}$$

$$F = 0.0174 \text{ lbs.} \frac{1}{3.875(10^{-4})\text{in}^2} \approx 45 \text{ psi}$$

if additional force is needed, more capacitors can be added.

Referring back to FIG. 3, as will be recognized by those of skill in the art, the type of dielectric material 24 can be chosen based upon its dielectric constant and the desired thickness of the dielectric material 24 can be chosen to achieve the desired attractive force between the two plates based upon the above cited equation. Some common types of dielectric material 24 which could be used are silicon nitride, silicone oxide, ONO, silicon oxynitride. In some embodiments, it may be advantageous to use dielectric materials with a high $\epsilon$. High-$\epsilon$ materials proposed for such capacitors include BT, ST, BST and PZT. In one embodiment, the dielectric material 24 also functions as the spacer to maintain the gap 19 between the faceplate 12 and the baseplate 14 as described above. When the dielectric material 24 is used as a spacer, the dielectric material 24 is preferably chosen to be xerogel. Xerogel has the advantage of being compliant which is useful in the sealing process (described in more detail below).

The first metal plate 22 which is formed on the faceplate 12 is formed of a suitably conductive metal or non-metal doped silicone and is preferably formed by photolithography. When the luminescent phosphor coating is applied to the lower surface of the faceplate 12 to form the pixel matrix 16 it is applied using a photolithography step as described in U.S. Pat. No. 5,695,661 cited above. In a preferred embodiment, the same photolithography step used to apply the luminescent phosphor coating to the lower surface of the faceplate 12 is used to apply the metal to form the first metal plate 22. Advantageously, by using the same photolithography step to form the first metal plate 22 and the luminescent phosphor coating, the first metal plate 22 is formed in alignment with the pattern of the luminescent phosphor pixel matrix 16.

The dielectric material 24 is preferably applied using a separate photolithography step depending upon the type of dielectric material 24 which is chosen. In an alternate embodiment, the dielectric material 24 may be attached to the first metal plate 22 on the faceplate using a suitable adhesive, such as vacuum-compatible epoxy.

Preferably, the second metal plate 26 which is formed on the baseplate 14 is formed of a suitably conductive metal or non-metal doped silicone and is formed by photolithography. When the electron-emission sites are formed on the baseplate 14 to form the cathode member 18 corresponding to the phosphorescent pixel matrix 16 on the faceplate 12, the electron-emission sites are formed using a photolithography step as described in U.S. Pat. No. 5,391,259 cited above. In a preferred embodiment, the same photolithography step that is used to form the electrode-emission sites of the cathode member 18 on the baseplate 14 is used to apply the metal to form the second metal plate 26. Advantageously, by using the same photolithography step to form the metal plate 26 and the cathode member 18, the second metal plate 26 is formed in alignment with the pattern of the electron-emission sites on the cathode member 18.

Figure 5:
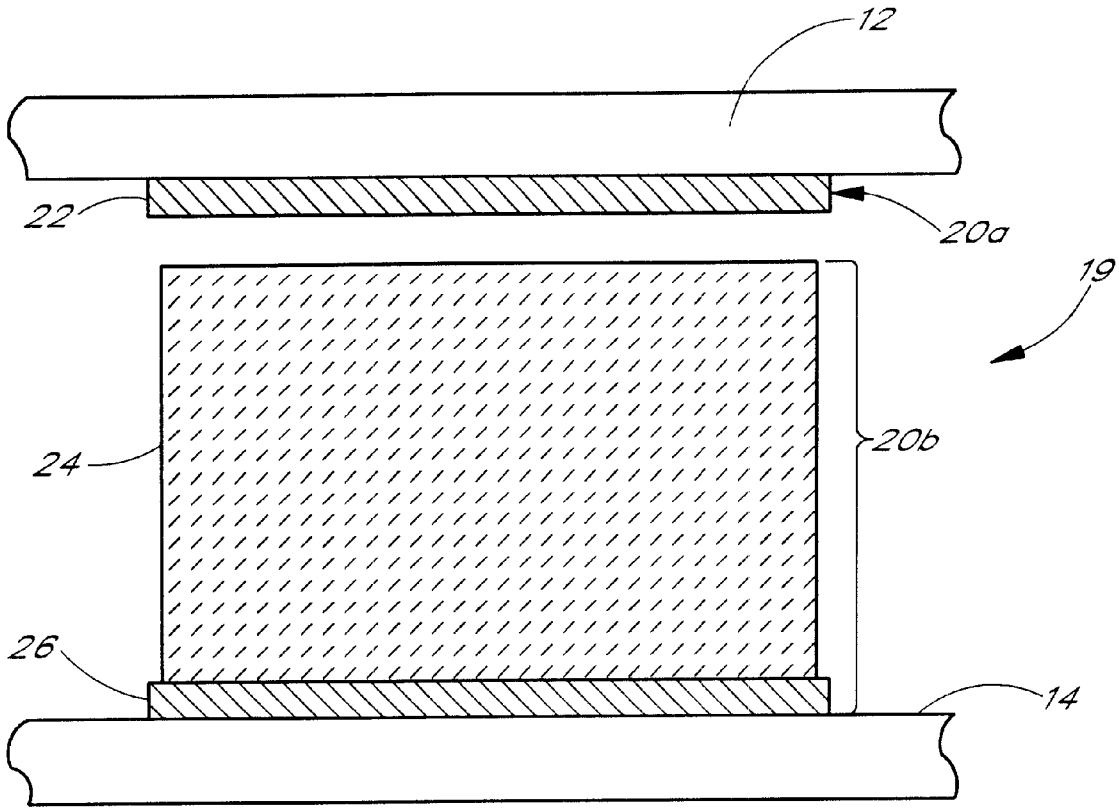
FIG. 5 is a cross sectional view of a capacitor formed on a faceplate and a baseplate of a flat panel display in accordance with an embodiment of the present invention.

In an alternate embodiment as shown in FIG. 5, the first portion 20*a* of the capacitor 20 which is formed on the faceplate 12 comprises a first metal plate 22. The second portion 20*b* of the capacitor 20 which is formed on the baseplate 14 comprises the dielectric material 24 and a second metal plate 26. As in the embodiment above, the distance between the first metal plate 22 on the faceplate 12 and the second metal plate 26 on the baseplate 14 is defined by the thickness of the dielectric material 24. The first metal plate 22 which is formed on the faceplate 12 and the second metal plate 26 which is formed on the baseplate 14 are formed by their respective photolithography steps as described above, so the first metal plate 22 is aligned with the pixel matrix 16 and the second metal plate 26 is aligned with the cathode member 18.

The only difference between the two embodiments is the dielectric material 24 in this embodiment is attached to the second metal plate 26 on the baseplate 14 instead of the first metal plate 22 on the faceplate 12 as shown in the embodiment of FIG. 4. The dielectric material 24 is preferably formed using an additional photolithography step, as described above. In an alternate embodiment, the dielectric material 24 is attached to the baseplate 14 using as suitable adhesive.

Figure 6:
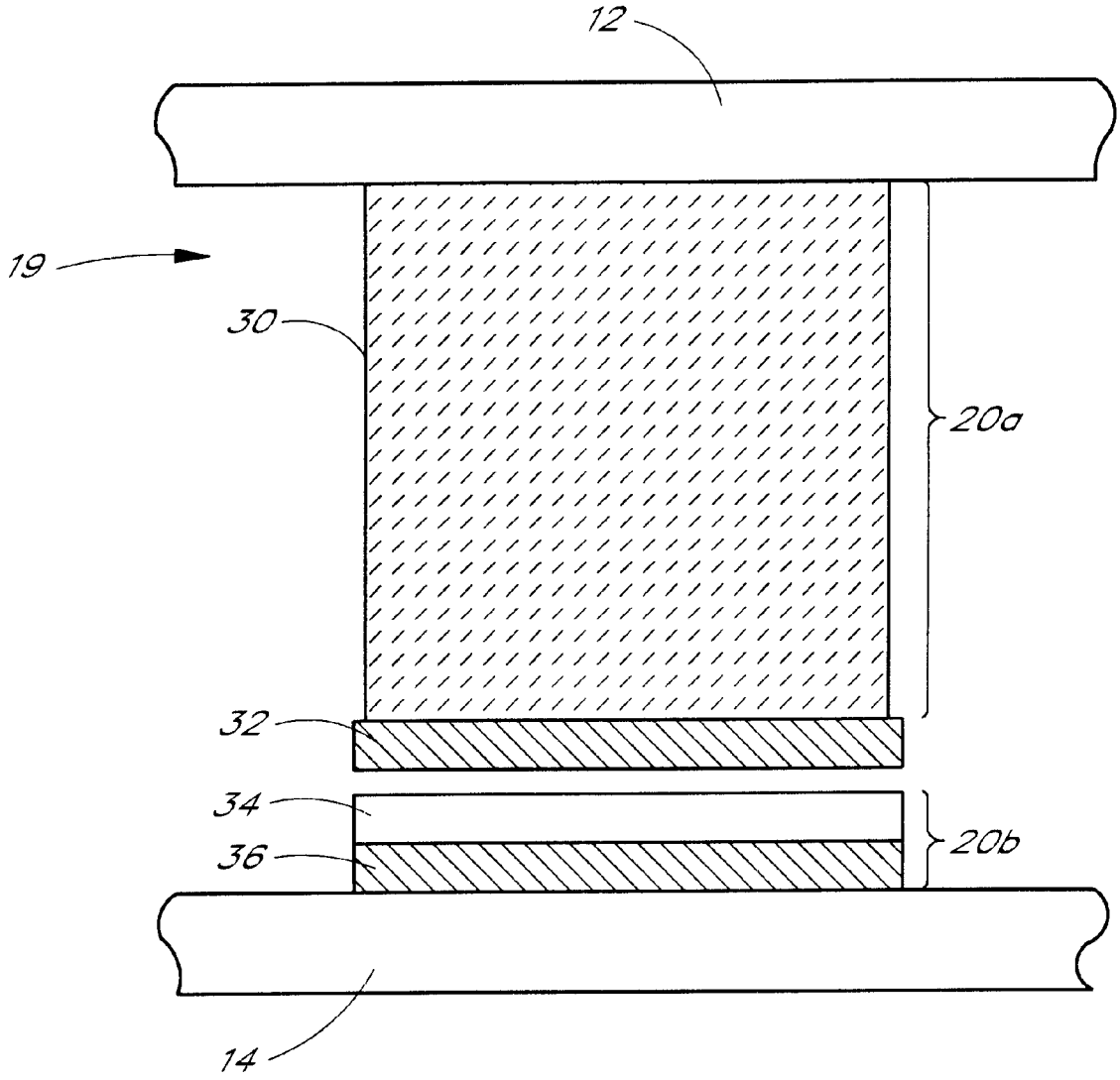
FIG. 6 is a cross sectional view of a capacitor formed on a faceplate and a baseplate of a flat panel display in accordance with an embodiment of the present invention.

Referring to FIG. 6, in still another embodiment the first portion 20*a* of the capacitor 20 which is formed on the faceplate 12 comprises a dielectric material 30 and a first metal plate 32. The second portion 20*b* of the capacitor 20 which is formed on the baseplate 14 comprises a dielectric material layer 34 and a second metal plate 36. In this embodiment, the distance between the first metal plate 32 on the faceplate 12 and the second metal plate 36 on the baseplate is defined by the thickness of the dielectric material layer 34. As will be recognized by those of skill in the art, the thickness of the dielectric material layer 34 and the type of material used for the dielectric material layer 34 can be chosen based upon its dielectric constant to achieve the desired attractive force between the first and second metal plates 32, 36 using the above cited equation. Suitable materials for the dielectric layers 30, 34 are similar to the dielectric materials described above in association with FIGS. 3 and 4.

The dielectric material layer 30 is preferably applied to the faceplate 12 using a separate photolithography step depending upon the type of dielectric material which is chosen. Preferably, the first metal plate 32 which is formed on the dielectric material 30 on the faceplate 12 is formed of a suitably conductive metal or non-metal doped silicon and is formed by photolithography. When the luminescent phosphor coating is applied to the lower surface of the faceplate 12 to form the pixel matrix 16 it is applied using a photolithography step as described in U.S. Pat. No. 5,695,661 cited above. In a preferred embodiment, the same photolithography step used to apply the luminescent phosphor coating to the lower surface of the faceplate 12 is used to apply the metal to form the metal plate 32. Advantageously, by using the same photolithography step to form the first metal plate 32 and the luminescent phosphor coating, the first metal plate 32 is formed in alignment with the pattern of the luminescent phosphor pixel matrix 16.

Preferably, the second metal plate 36 which is formed on the baseplate 14 is formed of a suitably conductive metal or non-metal doped silicon and is formed by photolithography. When the electron-emission sites are formed on the baseplate 14 to form the cathode member 18 corresponding to the phosphorescent pixel matrix 16 on the faceplate 12, the electron-emission sites are formed using a photolithography step as described in U.S. Pat. No. 5,391,259 cited above. In a preferred embodiment, the same photolithography step that is used to form the electrode-emission sites of the cathode member 18 on the baseplate 14 is used to apply the metal to form the second metal plate 36. Advantageously, by using the same photolithography step to form the metal plate 36 and the cathode member 18, the second metal plate 36 is formed in alignment with the pattern of the electron-emission sites on the cathode member 18. The dielectric material layer 34 is preferably applied over the metal plate 36 using a separate photolithography step depending upon the type of material which is chosen.

Figure 7:
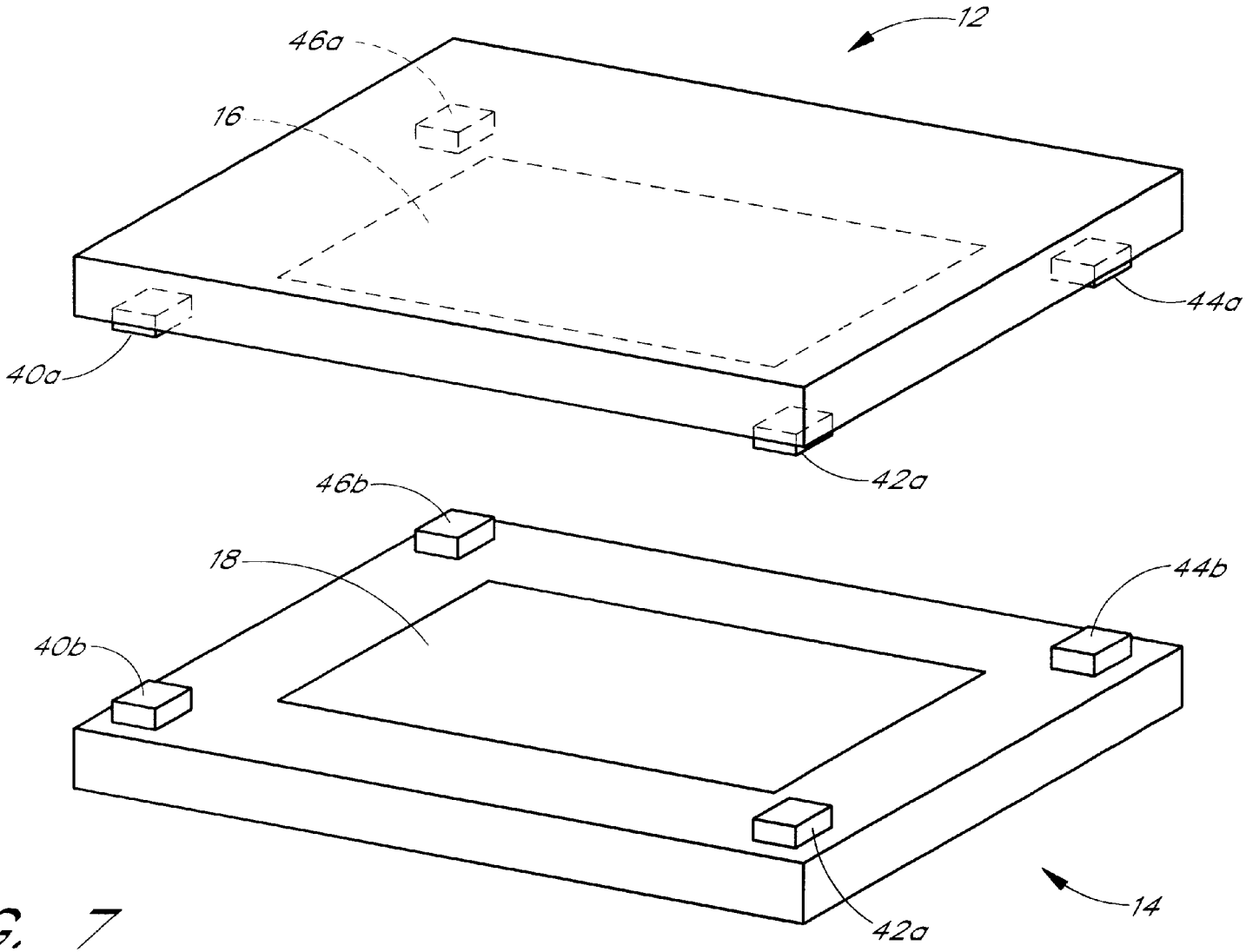
FIG. 7 is a perspective view of the faceplate and a baseplate of a flat panel display comprising a plurality of capacitors thereon in accordance with an embodiment of the present invention.

In one embodiment, at least one capacitor is formed between the faceplate 12 and baseplate 14. In another embodiment, at least two capacitors are formed between the faceplate 12 and baseplate 14 with the at least two capacitors located on opposite corners of the faceplate 12 and baseplate 14. Referring to FIG. 7, in a preferred embodiment, four capacitors 40, 42, 44, 46 are formed between the faceplate 12 and baseplate 14, one on each corner thereof. The faceplate 12 includes four first portions 40*a*–46*a* of the respective capacitors 40–46, one on each corner of the faceplate 12. The baseplate 14 includes four second portions 40*b*–46*b* of the respective capacitors 40–46, one on each corner of the baseplate 14. Preferably, each of the first portions 40*a*–46*a* of the capacitors 40–46 are separated from the cathode member 18 by the same distance. Similarly, each of the second portions 40*b*–46*b* of the capacitors 40–46 are separated from the pixel matrix 16 by the same distance.

Referring also to the embodiment illustrated in FIG. 3, for example, when the first and second metal plates 22, 26 of the capacitors 40–46 are energized to opposite polarity voltages, the electric field that is formed creates a force which that attracts the first and second plates 22, 26 to each other and aligns each of the first portions 40*a*–46*a* of the capacitors 40–46 with their respective second portions 40*b*–46*b* of the capacitors 40–46. When each of the first and second portions 40*a*–46*a*, 40*b*–46*b* of the capacitors 40–46 at each corner of the field emission display are aligned, the pixel matrix 16 and cathode 18 assembly are inherently aligned with each other, since the same photolithography step was used to form the first and second metal plates 22, 26 of the capacitors 40–46 as was used to form the respective pixel matrix 16 and cathode member 18.

Figure 8:
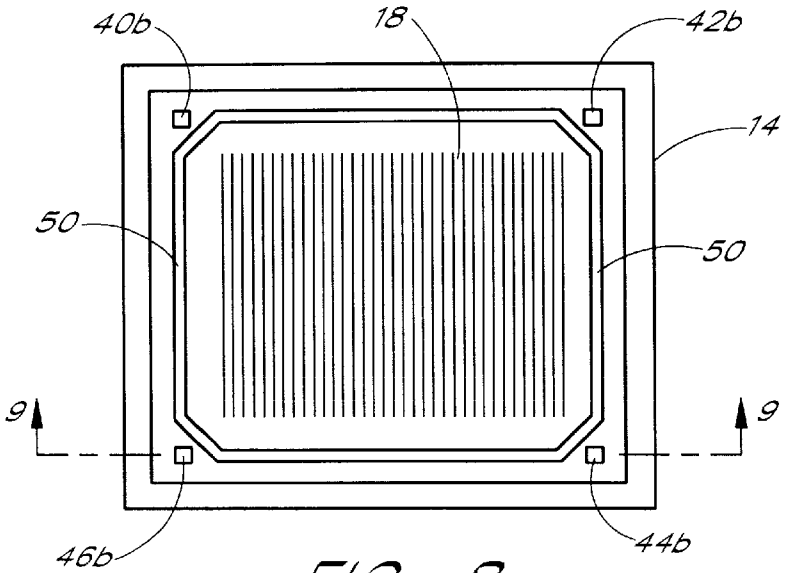
FIG. 8 is a top view of the baseplate in accordance with an embodiment of the present invention.
Figure 9:
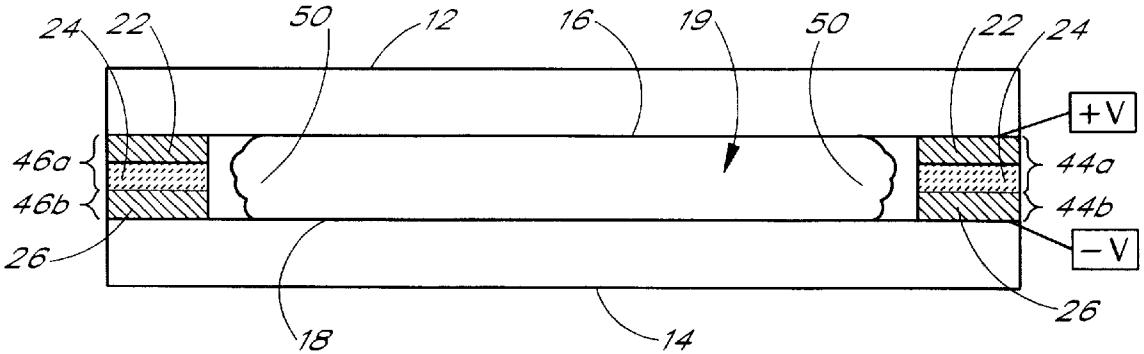
FIG. 9 is a cross sectional view of a faceplate and a baseplate of a flat panel display in an aligned and attracted state in accordance with an embodiment of the present invention.

Referring to FIGS. 7–9, before the faceplate 12 and baseplate 14 are aligned and attached to each other, a seal 50, such as a frit seal, is disposed on baseplate 14 or in an alternate embodiment (not shown) on the faceplate 12. The seal 50 and/or spacers (not shown) are used to maintain the vacuum gap 19, ranging from a few tens of microns to many millimeters, between the faceplate 12 and the baseplate 14. As known to those of skill in the art, making the gap 19 as small as possible lowers the extraction voltage required to accelerate the electrons from the cathode member 18 on the baseplate 14 to the pixel matrix 16 on the faceplate 12 which in turn reduces the cost of the driver electronics required to excite the electrons. The sealing member 50 and/or spacers (not shown) maintain the required vacuum (for example 10–6 Torr) and prevent the outside atmospheric pressure from collapsing the faceplate 12 and baseplate 14 onto each other. In the preferred embodiment, a frit seal is used.

Preferably, with the frit seal 50 disposed between the faceplate 12 and baseplate 14, the first and second metal plates 22, 26 of capacitors 40–46 are energized to opposite polarity voltages and as described above the electric filed that is created causes the faceplate 12 and baseplate 14 to be attracted to each other. In addition, since the first and second portions of capacitors 40–46 are respectively aligned with the pixel matrix 16 and cathode member 18, the pixel matrix 16 and cathode member 18 are automatically aligned with each other. Once in this aligned and attached state, the flit seal 50 is heated to a temperature sufficient to cause the frit to seal the baseplate 14 and faceplate 12 together. Once the seal 50 is created, the first and second metal plates 22, 26 on the faceplate 12 and baseplate 14 respectively are de-energized. With the applied voltage removed, the electric field within the capacitors 40–46 dissipates and the attraction between the baseplate 14 and faceplate 12 disappears. Thus, the faceplate 12 and baseplate 14 are now held together only by the frit seal 50.

Advantageously, once the baseplate 14 and faceplate 12 are aligned by applying the voltage to the capacitors 40–46, if a problem in the alignment or sealing process occurs, the applied voltage may be removed and the attractive force between the faceplate 12 and baseplate 14 disappears and the two plates can be easily separated. In the other types of temporary attachment methods common in the prior art, such as laser tacking and the use of adhesives, the attachment is more permanent and would require the use of solvents or heating processes to separate the faceplate 12 and the baseplate 14 before realignment could occur. The use of solvents or heating to separate the faceplate 12 and baseplate 14 could damage the faceplate 12 or baseplate 14 at the attachment location and could render the faceplate 12 or baseplate 14 unusable. The system of the present invention does not suffer from this disadvantage as the opposite polarity voltages could be applied to the first and second plates 22, 26 of the capacitors 40–46 to attract the baseplate 14 and faceplate 12 and then be removed if realignment is required. The application and removal of the opposite polarity voltage may be instituted as many times as necessary until the baseplate 14 and faceplate 12 are properly aligned and attached together without damaging the baseplate 14 or faceplate 12.

Figure 10:
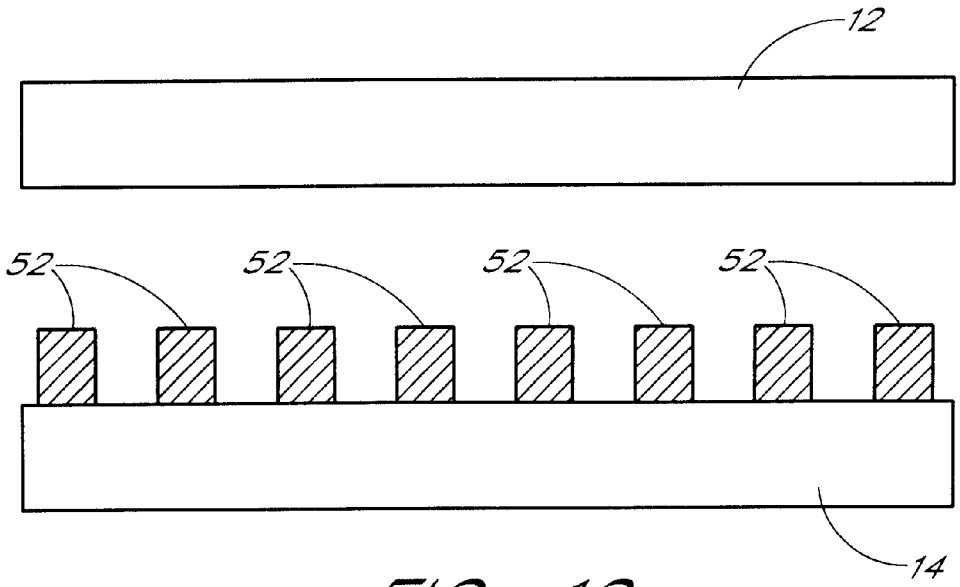
FIG. 10 is a cross sectional view of a faceplate and a baseplate having an array of conductors thereon in accordance with an alternate embodiment of the present invention.
Figure 11:
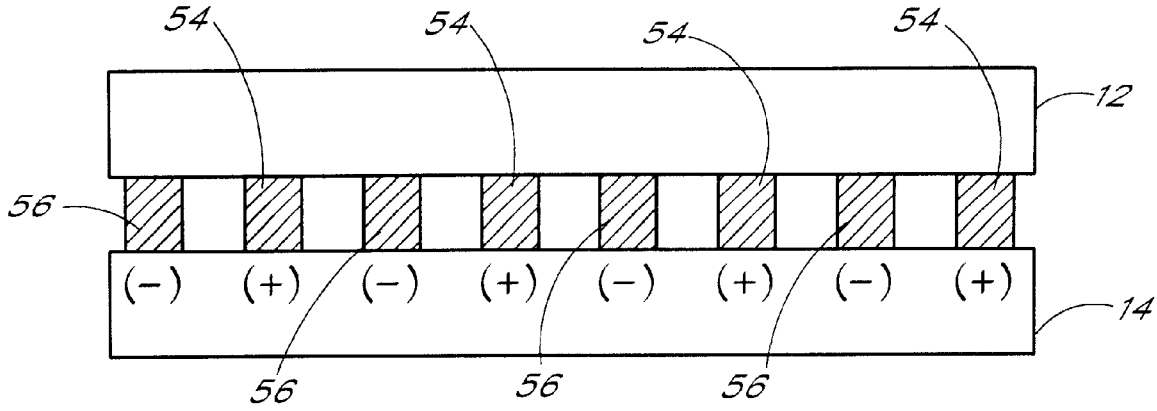
FIG. 11 is a cross sectional view of a faceplate and a baseplate having an array of conductors energized to opposite polarity voltages thereon in accordance with an alternate embodiment of the present invention.

In an alternate embodiment, as shown in FIGS. 10 and 11, electrostatic surface adhesion is used to create the electric field to attract the faceplate 12 and baseplate 14 to each other. In this embodiment, a plurality of interdigitated conductors 52 are buried in the baseplate 14, which is inherently an insulative material. As shown in FIG. 11, when every other conductor 54 is charged to a positive voltage and the remaining every other conductor 56 is charged to an opposite voltage, the array of conductors creates an electric field just above the surface of the baseplate 14. As the faceplate 12 is placed into the proximity of the baseplate 14, the electrostatic force pulls it closer to the surface of the baseplate 14 and causes the faceplate 12 to adhere to the baseplate 14. When the conductors 52 are discharged, the adhesive force disappears.

Preferably, the array of conductors 52 which is formed on the baseplate 14 is formed of a suitably conductive metal or non-metal doped silicone by photolithography. When the electron-emission sites are formed on the baseplate 14 to form the cathode member 18 corresponding to the phosphorescent pixel matrix 16 on the faceplate 12, the electron-emission sites are formed using a photolithography step as described in U.S. Pat. No. 5,391,259 cited above. In a preferred embodiment, the same photolithography step that is used to form the electrode-emission sites of the cathode member 18 on the baseplate 14 is used to form the array of conductors 52.

In an alternate embodiment (not shown), the array of conductors 52 is formed on the faceplate 12 instead of the baseplate 14. Preferably, as described above, the same photolithography step used to apply the luminescent phosphor coating to the lower surface of the faceplate 12 is used to form the array of conductors 52 on the faceplate 12.

Figure 12:
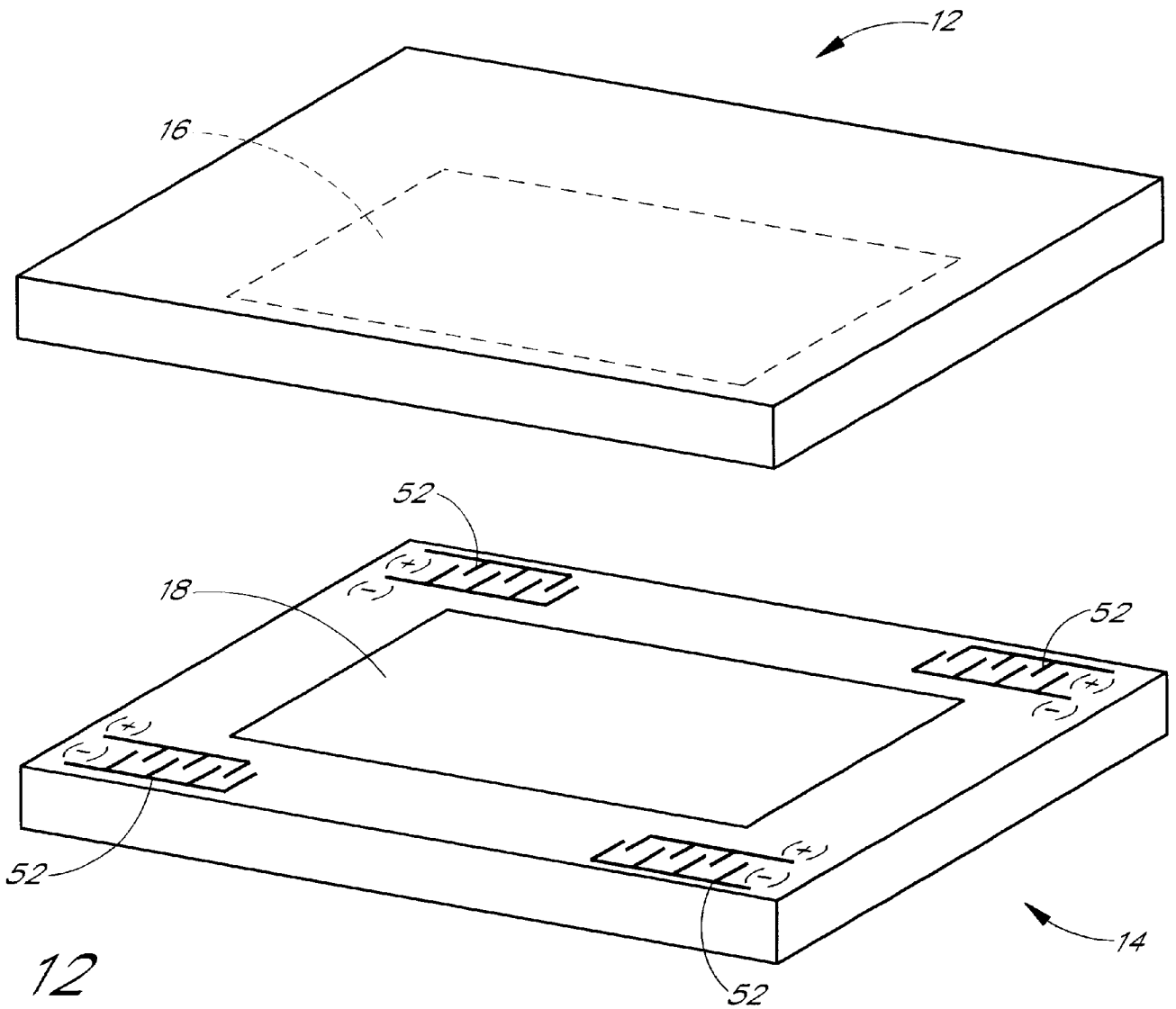
FIG. 12 is a perspective view of the faceplate and a baseplate of a flat panel display comprising a plurality of arrays of conductors thereon in accordance with an alternate embodiment of the present invention.

In one embodiment, at least one array of conductors 52 are formed on the baseplate 14. In another embodiment, at least two arrays of conductors are formed on the baseplate 14 on opposite corners of the baseplate 14. Referring to FIG. 12, in a preferred embodiment, four separate arrays of conductors 60, 62, 64, 66 are formed on the baseplate 14, one on each corner thereof. As described above, when every other conductor is charged to an opposite voltage, the array of conductors creates an electric field just above the surface of the baseplate 14, such that when the faceplate 12 is placed into the proximity of the baseplate 14, the electrostatic force pulls it closer to the surface of the baseplate 14 and causes the faceplate 12 to adhere to the baseplate 14.

As described above in association with FIGS. 7–9, when the faceplate 12 and baseplate 14 are attracted to each other by an electric field, the faceplate 12 and baseplate 14 are then permanently attached and sealed together. Once this process is complete, the conductors 52 are discharged and the adhesive force disappears. As described in association with the other embodiments, the array of conductors 52 can be charged and discharged as needed to realign the faceplate 12 and baseplate 14 as needed until the final adhesion and sealing is completed. The only disadvantage of this embodiment over the other embodiments is this embodiment does not have the automatic alignment feature since the entire array of the conductors is located on either the baseplate or faceplate and there is no corresponding portion array of conductors on the other plate to align with.

Although described above with reference to the preferred embodiments, modifications within the scope of the invention may be apparent to those skilled in the art, all such modifications are intended to be within the scope of the appended claims.

What is claimed is:

1. A flat panel display, comprising:

a faceplate;

a baseplate; and a plurality of interdigitated conductors formed on at least one of said faceplate and said baseplate, wherein said interdigitated conductors are configured such that a voltage applied to the conductors will cause the faceplate and the baseplate to be attracted together.

2. The flat panel display of claim 1, wherein the plurality of interdigitated conductors are arranged into a plurality of arrays of conductors.

3. The flat panel display of claim 2, comprising at least two arrays of conductors formed on opposite corners of one of said faceplate and said baseplate.

4. The flat panel display of claim 3, comprising four separate arrays of conductors formed on-each corner of one of said faceplate and said baseplate.

5. The flat panel display of claim 1, wherein said plurality of conductors are formed on said faceplate.

6. The flat panel display of claim 1, wherein said plurality of conductors are formed on said baseplate.

7. The flat panel display of claim 1, wherein every other conductor is charged to a positive voltage and the remaining every other conductor is charged to an opposite voltage.

8. A flat panel display comprising:

a faceplate;

a baseplate; and a capacitor having first and second portions thereof, wherein said first portion of said capacitor is formed on said faceplate and said second portion of said capacitor is formed on said baseplate;

wherein said first portion and said second portion are configured such that energizing the first and second portions with voltages of opposite polarity will create an electric field that causes said first and second portions to be attracted to each other; whereby said faceplate and said baseplate are at least temporarily held together.

9. A flat panel display, comprising:

a faceplate;

a baseplate; and a plurality of interdigitated conductors formed on at least one of said faceplate and said baseplate, wherein said interdigitated conductors are configured such that applying an electric potential to the conductors results in the faceplate and the baseplate being attracted together.

10. The flat panel display of claim 9, wherein the plurality of interdigitated conductors are arranged into a plurality of arrays of conductors.

11. The flat panel display of claim 10, comprising at least two arrays of conductors formed on opposite corners of one of said faceplate and said baseplate.

12. The flat panel display of claim 11, comprising four separate arrays of conductors formed on each corner of one of said faceplate and said baseplate.

13. The flat panel display of claim 9, wherein said plurality of conductors are formed on said faceplate.

14. The flat panel display of claim 9, wherein said plurality of conductors are formed on said baseplate.

15. The flat panel display of claim 9, wherein every other conductor is charged to a positive voltage and the remaining every other conductor is charged to an opposite voltage.

16. A flat panel display, comprising:

a faceplate;

a baseplate;

a capacitor having first and second portions thereof, wherein said first portion of said capacitor is formed on said faceplate and said second portion of said capacitor is formed on said baseplate;

wherein said first portion and said second portion are arranged such that creating an electric potential between the first and second portions will create an electric field that causes said first and second portions to be attracted to each other.

* * * * *